US005452406A

United States Patent [19]

Butler et al.

[11] Patent Number: 5,452,406

[45] Date of Patent: Sep. 19, 1995

[54] METHOD AND SYSTEM FOR SCALABLE BORDERS THAT PROVIDE AN APPEARANCE OF DEPTH

[75] Inventors: Laura J. Butler, Bellevue; Joyce A. Grauman, Seattle, both of Wash.

[73] Assignee: Microsoft Corporation, Redmond, Wash.

[21] Appl. No.: 62,845

[22] Filed: May 14, 1993

[51] Int. Cl.[6] ..... G09G 1/06

[52] U.S. Cl. ..... 395/126; 395/157; 395/158

[58] Field of Search ..... 395/157, 158, 131, 128, 395/119, 161, 126

[56] References Cited

U.S. PATENT DOCUMENTS

| | | | |
|---|---|---|---|
| 4,709,231 | 11/1987 | Sakaibara et al. | 395/126 |
| 4,831,556 | 5/1989 | Oono | 395/157 |
| 5,091,720 | 2/1992 | Wood | 395/157 X |
| 5,103,407 | 4/1992 | Gabor | 395/161 X |
| 5,142,273 | 5/1992 | Wobermin | 340/703 |
| 5,263,134 | 11/1993 | Paal et al. | 395/157 X |
| 5,293,470 | 3/1994 | Birch et al. | 395/157 X |
| 5,297,250 | 3/1994 | Leroy et al. | 395/157 |

FOREIGN PATENT DOCUMENTS

| | | | |
|---|---|---|---|
| 0212016 | 3/1987 | European Pat. Off. | G09G 1/00 |
| 0352741 | 1/1990 | European Pat. Off. | G09G 1/00 |

OTHER PUBLICATIONS

Mastering Windows 3.1 (Trademark of Sybex Inc.), 1992, p. 55, pp. 151–157, 168–170, 776–778 & attached sheet #1.

"Writing Applications for the Solaris Environment, vol. II; A Guide for Windows Programmers"; Sunsoft, Inc.; pp. 106, 120 and 197–199; Jan. 1992.

"NeXTSTEP General Reference, vol. 1 "; NeXTSTEP Developer's Library, Release 3; NeXT Computer, Inc.; pp. 2–76 and 2–79; Nov. 1992.

"OSF/Motif Programmer's Reference"; Revision 1.2 (For OSF/Motif Release 1.2); Open software foundation; pp. 1–2; 1–9 and 1–40; Copyright 1989, 1990, 1993 Open Software Foundation, Inc.

"OSF/Motif Style Guide"; Revision 1.2(For OSF-/Notif Release 1.2); Open Software Foundation; pp. 9–12, 9–19, 9–25, 9–31, 9–41 and 9–99; Copyright 1989, 1990, 1993 Open Software Foundation, Inc.

"Open Look Graphical User Interface Application Style Guidlines"; Sun Microsystems, Inc.; p. 321; Dec. 1989.

"Open Look Graphical User Interface Functional Specification"; Sun Microsystems, Inc.; pp, 95, 97, 99, 103, 105, 201–217; Nov. 1989.

Screen Snapshots GEM Desktop, Digital Research, Inc. (1987).

"Shrinking the Action Bar until Icons Replace Menu Names, " *Research Disclosure,* No. 297, p. 33, Jan. 1989.

*Primary Examiner*—Heather R. Herndon
*Assistant Examiner*—Cliff Nguyen Vo
*Attorney, Agent, or Firm*—Seed and Berry

[57] ABSTRACT

Scalable three-dimensional borders are provided in the user interface of an operating system. The borders are scalable in several respects. First, the dimensions of the borders are scalable relative to the resolution of a video display upon which the borders will be drawn. Second, the colors used in the borders are scalable based upon the range of luminances available on the video display. The borders are colored to provide the visual illusion of depth such that the borders appear to be three-dimensional.

10 Claims, 4 Drawing Sheets

METHOD AND SYSTEM FOR SCALABLE BORDERS THAT PROVIDE AN APPEARANCE OF DEPTH

TECHNICAL FIELD

The present invention relates generally to data processing systems and, more particularly, to the use of scalable three-dimensional borders in a user interface of a data processing system.

BACKGROUND OF THE INVENTION

Many operating systems provide user interfaces that are well adapted for display on video displays of a given type but are not well adapted for display on video displays of other types. For instance, the borders of items in a user interface may not be clearly legible on video displays with high resolution. In addition, the colors of borders in the user interface may also not be well suited for given types of video displays.

The borders that are provided in user interfaces are typically two dimensional borders that provide no sense of depth. As a result, the user interfaces do not provide visual cues to users regarding the nature of items (like buttons) which are presumed to be three dimensional. Three dimensional borders have been used in certain user interfaces, but have generally been unsatisfactory.

SUMMARY OF THE INVENTION

In accordance with a first aspect of the present invention, a method is practiced in the data processing system having a memory means, an output device, such as a printer or video display, and a processor that produces a user interface. The output device has a resolution that may be specified in terms of number of horizontal dots (e.g., pixels) per inch and number of vertical dots per inch. In accordance with the method, a minimum border width for each border in the user interface is determined by the processor. The minimum border width is chosen to be sufficiently visible for the given resolution of the output device. The processor is also used to determine a minimum border height for each border in the user interface. The minimum border height is chosen to be sufficiently visible for the given resolution of the output device. Vertical edges of the borders are drawn in the user interface to have the minimum border width, and horizontal edges of the borders are drawn to have the minimum border height.

The memory means of the data processing system may hold system metrics, including the minimum border height and the minimum border width. In addition, other system metrics may be scaled to have values that are proportional to the minimum border height or the minimum border width. These other system metrics are stored in the memory means as well.

The minimum border width may be calculated as an integer portion of the sum of the number of horizontal dots per inch on the output device and seventy-one, divided by seventy-two. Likewise, the minimum border height may be calculated as an integer portion of (the sum of the number of vertical dots per inch on the output device and 71) divided by 72. The borders may be drawn as three-dimensional borders.

In accordance with another aspect of the present invention, a method of drawing a border with the output device is practiced. The border includes an inner border having border edges and an outer border having border edges. In the method, a range of logical depths (relative to a zero level surface of the output device) which may be assumed by the inner border and outer border are established. The range includes at least one sunken logical depth and at least one raised logical depth. For each logical depth, the border edges of the inner border or the outer border are pre-determined, and the colors produce a visual effect of the logical depth when the borders are output on the output device. The border is output by the output device by drawing the outer border to have a first logical depth and drawing the inner border to have a second logical depth. The outer border has border edges with the colors assigned to the border edges for the first logical depth. Similarly, the inner border has border edges with the colors assigned to the border edges for the second logical depth.

The range of logical depths may include at least two raised logical depths and at least two sunken logical depths. The colors may be assigned to the border edges by first determining where a logical light source is located on the zero level surface relative to the border. Then, for each logical depth, given the logical, light source location, a determination is made regarding which of the border edges of the inner border or the outer border are in shadow and which of the border edges are in glare. The border edges that are in glare are assigned a first color, and the border edges that are in shadow are assigned a second color. When the logical light source is presumed to be positioned in the top left corner of the zero level surface and the border is at a raised logical depth, the top and left border edges are in glare and the bottom and right border edges are in shadow. Conversely, when the logical light source is positioned in the top left corner of the output surface and the border is at a sunken logical depth, the top and left border edges are in shadow, and the bottom and right border edges are in glare.

In accordance with yet another aspect of the present invention, a method is practiced in a data processing system such that a required number of shades to differentiate amongst heights that borders may assume when displayed on the output device is determined. A processor of the data processing system is used to determine the range of luminances available on the output device. The processor is also used to determine the luminance values of the shades to be used in displaying the borders. The shades are evenly spread across the range of luminances. A border is then drawn using the output device which has portions at different heights. The portions at different heights are assigned different ones of the determined luminance values to differentiate the heights.

BRIEF DESCRIPTION OF THE DRAWINGS

A preferred embodiment of the present invention will be described hereinafter with reference to the drawings. The drawings include the following figures.

DETAILED DESCRIPTION OF THE INVENTION

A preferred embodiment of the present invention provides scalable three-dimensional borders for graphic elements of a system user interface. The borders are scalable in that they may be scaled for display with different types of systems. The borders provided by the preferred embodiment of the present invention are three dimensional in that they are shaded to give the illusion of depth.

Figure 1:
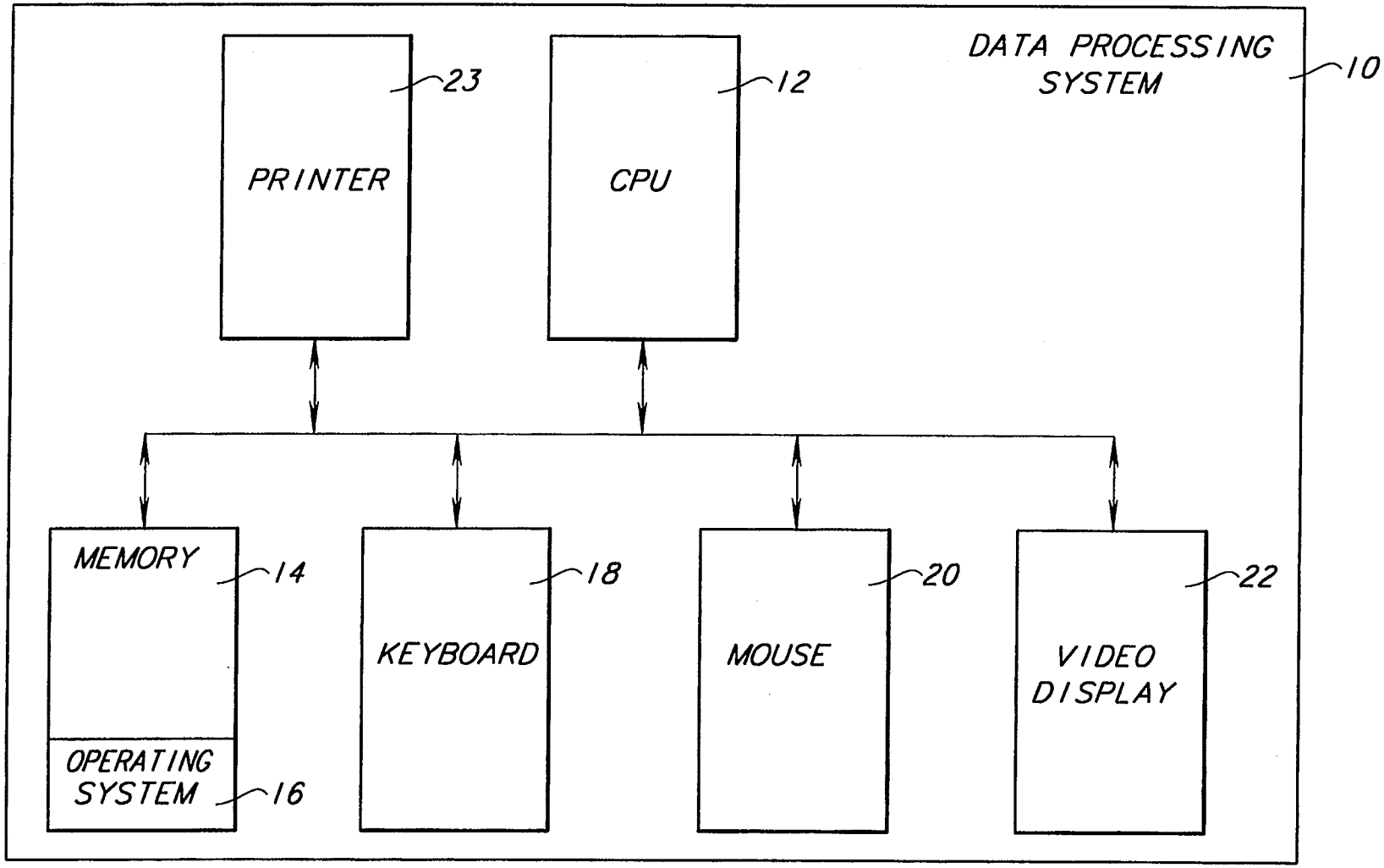
FIG. 1 is a block diagram of a data processing system that is suitable for practicing the preferred embodiment of the present invention.

FIG. 1 is a block diagram illustrating a data processing system 10 for implementing the preferred embodiment of the present invention. The data processing system 10 includes a single central processing unit (CPU) 12. Those skilled in the art will appreciate that the present invention is not limited to use within a single processor data processing system; rather, the present invention may also be implemented in data processing systems having more than one processor, such as a distributed system. The data processing system 10 includes a memory 14 that may include different types of storage, such as RAM, ROM and/or secondary storage. The memory 14 holds numerous items, including a copy of an operating system 16. The preferred embodiment of the present invention is implemented by code that is incorporated into the operating system 16. A keyboard 18, a mouse 20, a video display 22, and a printer 23 are also provided in the data processing system 10.

The preferred embodiment of the present invention will be described hereinafter relative to output on the video display 22. It should be appreciated that the present invention also is applicable to borders that are printed on printers, such as printer 23.

A first type of scalability provided by the preferred embodiment of the present invention concerns the scalability of dimensions of the borders (i.e., border width and border height). The border height and border width are scalable to compensate for the resolution of the video display 22 so that the borders are readily visible. Border width is set in the preferred embodiment as the minimum number of pixels that are required to clearly see a vertical border line on the video display 22. Border height, in contrast, is set as the minimum number of pixels required to clearly see a horizontal border line on the video display 22. If the output is destined instead for printer 23, the minimum border height and minimum border width are specified in terms of dots. In general, "dots" is used hereinafter to encompass both pixels and dots generated by a printer (such as a dot matrix printer).

A border is formed by a rectangular frame whose vertical border edges are 1 border width wide and whose horizontal border edges are 1 border height high. The border height and border width are determined primarily by the size of the pixels provided on the video display 22. Large pixels imply a small border height and a small border width, whereas small pixels imply a large border height and a large border width. In general, given a resolution of 72 pixels per inch, a border width of 1 and a border height of 1 are sufficient for the border edges to be clearly visible. Many video displays 22, however, have a greater resolution than 72 pixels per inch and, thus, have smaller pixels. In such video displays, a border width of 1 and a border height of 1 result in a border that is not clearly visible to most viewers. The preferred embodiment of the present invention, in contrast, provides a border having a greater border width and a greater border height that results in the borders being more visible.

Figure 2:
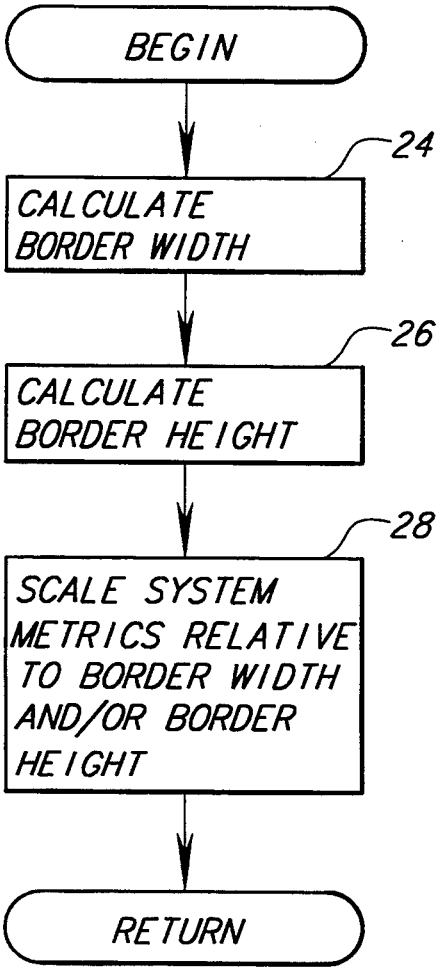
FIG. 2 is a flowchart illustrating the steps that are performed to scale border dimensions relative to video display resolution and to scale system metrics relative to the border dimensions in accordance with the preferred embodiment of the present invention.

FIG. 2 is a flowchart showing the steps performed by the preferred embodiment of the present invention to scale the border height and border width of the borders to account for the resolution of the video display 22. First, a border width that has the minimum number of pixels that are necessary to make the border sufficiently visible, given the resolution of the video display 22, is calculated (step 24). The border width is calculated to be equal to (the sum of the number of horizontal pixels per inch on the video display and 71) divided by 72. The border height is also calculated in an analogous manner (step 26). The border height is calculated as (the sum of the number of vertical pixels per inch and 71) divided by 72. If the border output is destined for printer 23, resolution is measured in terms of dots per inch.

The calculated values of the border width and the border height are stored as "system metrics" (such as found in the Microsoft WINDOWS, version 3.1, operating system). The operating system 16 provides a number of system metrics that may be accessed using the GetSystemMetrics() function. The system metrics provide a convenient means for quickly obtaining metrics for graphical activities. A parameter that is passed to the GetSystemMetrics() function is an index to one of the system metrics. The border width and the border height are stored as separately indexed system metrics (SM_CXBORDER and SM_CYBORDER, respectively). To preserve relative dimensions among the system metrics, the preferred embodiment of the present invention scales the other system metrics relative to the border width and/or the border height (step 28). In particular, the system metrics that relate to the X dimension are scaled relative to the border width, and the system metrics that relate to the Y dimension are scaled relative to the border height. The system metrics that do not relate to either the X dimension or the Y dimension are not scaled. For example, a system metric is provided to specify the tolerance in the X direction for a double click of the mouse (i.e., how close the cursor must be to an object in the X direction before a double click of the mouse is deemed to be a double click on the object). This system metric is scaled relative to border width. Thus, not only are border width and border height scalable, but the outer system metrics are also scalable in the preferred embodiment of the present invention.

The preferred embodiment of the present invention provides three-dimensional borders. Several assumptions are made in order to provide three-dimensional borders. First, the surfaces of all borders are assumed to be composed of a solid-color metallic material which reflects all light that strikes them. Moreover, since each surface is assumed to be a solid, depth changes are rendered as linear color changes.

A "shadow" border edge is a border edge which neither receives direct light nor has a line of sight with a light source. A "glare" border edge is a border edge which receives both direct light and has a line of sight with the light source. Shadow border edges and glare border edges are rendered in a linear fashion. Border edges which are not shadows border edges or glare border edges are glance border edges that receive diffuse lighting.

Another assumption made by the preferred embodiment of the present invention is that the light source for all displayed objects is in the top lefthand corner of the video display 22. The preferred embodiment further assumes that all border surfaces are composed of planes that are either parallel to the video display surface or perpendicular to the video display surface. The border surfaces that are parallel to the screen are flat, whereas the border surfaces that are perpendicular to the video display surface lead to flat border surfaces that appear raised above or sunken below the level of another parallel surface. The border surfaces are assumed to be rectangular.

As a result of these constraints, the borders provided by the preferred embodiment are rectangular frames having glare border edges and shadow border edges that vary from the surface color by being lighter or darker than the surface color, respectively. The glare border edges mark transitions from a flat surface below the level of another flat surface. The shadow border edges mark transitions from a flat surface above the level of another flat surface.

Figure 3:
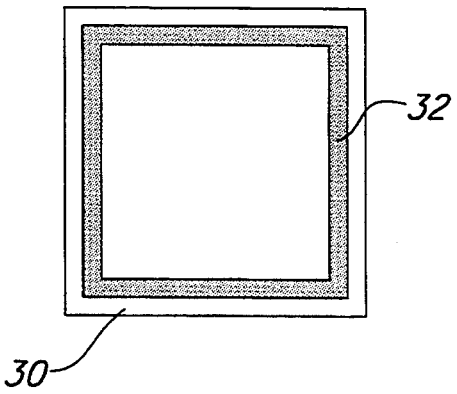
FIG. 3 is an example of a combined border generated in accordance with the preferred embodiment of the present invention.

Each border is divided into an outer border 30 (FIG. 3) and an inner border 32. The outer border 30 and inner border 32 are concentric, as shown in FIG. 3. The outer border 30 and the inner border 32 each have a relative depth that specifies how the border should appear relative to the video display surface (i.e., surface below the surface or raised above the surface).

Shading is used provide the illusion of depth of the outer border and the inner border. The shades that are used for the different depths of the inner border and outer border are defined in relative terms that may be easily scaled to the range of colors available on different systems. The range of available colors is defined by the video display and/or a video adapter for the display 22. In the preferred embodiment, the maximum transition of depth between two flat border surfaces is 2. In other words, if the depths are divided into logical levels, the maximum transition is two levels. Using this maximum transition of depth, the total number of shades required to properly shade the outer border 30 and the inner border 32 may be calculated as the sum of 1 plus 2 times the maximum depth (i.e., $1+(2\times2)$, which equals 5). The maximum depth is multiplied by 2 in the calculation to account for the border having two parts (i.e., inner border and outer border).

The changes in the shading to differentiate depths of borders are performed by varying the luminance of portions of the borders. The luminance is a measure of the brightness or darkness of a color as it appears on the video display 22 (FIG. 1).

Figure 4:
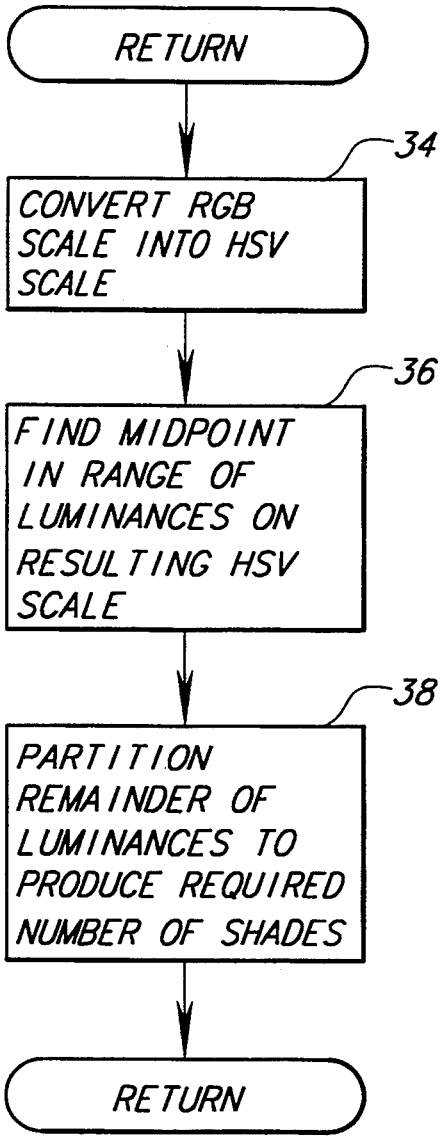
FIG. 4 is a flowchart illustrating the steps performed to determine a range of luminance values for shades that are assigned to border edges in accordance with the preferred embodiment of the present invention.

FIG. 4 shows a flowchart of the steps performed by the preferred embodiment of the present invention to scale the luminance values for the borders. In general, most video displays 22 (FIG. 1) and their adapters specify colors according to a red, green and blue (RGB) scale. The preferred embodiment of the present invention performs a conversion from the RGB scale to a hue, saturation and value (HSV) scale at system startup (i.e., each color is defined as a combination of hue, saturation and luminance). Saturation refers to the amount of intensity, and hue refers to a color family (e.g., pink). Value may be viewed as a grey scale version of a color, wherein the magnitude of the value specifies the amount of white in the color. The result of the conversion is used to obtain a range of luminances (which is quantified as the "value") that are available on the video display 22 (step 34 in FIG. 4). A midpoint is then found in the range of luminances (step 36). The midpoint corresponds with the luminance of a "basic color" for border edges at depth 0. The remainder of the luminances are then partitioned to locate the required number of shades (step 38). In particular, the luminance values are partitioned to find shades that are evenly distributed across the range of luminances.

For example, suppose that the luminances available on the video display 22 span a range from 0 to 240 in the HSV scale. The midpoint, at luminance 120, is a medium gray color in a monochrome scale. The remaining luminances are partitioned to locate four other shades that are equally spread across the range of available luminances. In the example range of 0 to 240, the four other shades are at 0 (i.e., black), 60 (i.e., dark gray), 180 (i.e., light gray) and 240 (i.e., white). The darker shades, 0 and 60, are used for the shadow border edges, whereas the lighter shades, 180 and 240, are used for the glare border edges.

In addition to adjustments in luminances, the shadow border edges and glare border edges also differ slightly as to luminance values. Specifically, saturation values are increased by 10% for glare border edges and decreased by 10% for shadow border edges. The saturation values are increased for glare border edges because light reflects strongly off such border edges. In contrast, the saturation values are decreased for shadow border edges because light reflects weakly off such border edges.

A number of "equivalence classes" are defined for each of the depths, which range from $-2$ to $+2$ in the preferred embodiment of the present invention. The $+1$ equivalence class is for a raised outer border; the $+2$ border equivalence class is for a raised inner border; the $-1$ equivalence class is for a sunken outer border; and the $-2$ equivalence class is for a sunken inner border. Depth 0 is ignored because it represents the border surface at the video display surface. Each equivalence class has a number of colors that are uniquely associated with it. In particular, a glare border edge color, a glance border edge color and a shadow border edge color are associated with each equivalence class. As was discussed above, each border edge of a border is either a glare border edge, a glance border edge or a shadow border edge. In the preferred embodiment of the present invention, it is assumed that the light source is in the top left-hand corner of the video display 22 (FIG. 1). As a result, each border includes only glare border edges and shadow border edges.

The preferred embodiment of the present invention utilizes a set of single borders (i.e., raised inner border, raised outer border, sunken inner border and sunken outer border) as building blocks. When the borders are raised, the borders are constructed by combining a lighter shade for the top and left border edges (glare border edges) with a darker shade for the bottom and right border edges (shadow border edges). However, when the borders are sunken, the roles are reversed such that the top and left border edges are given a darker shade (shadow border edges) and the right and bottom border edges are given a lesser shade (glare border edges). FIGS. 5*a*–5*d* provide depictions of the resulting four building block borders.

Figure 5A:
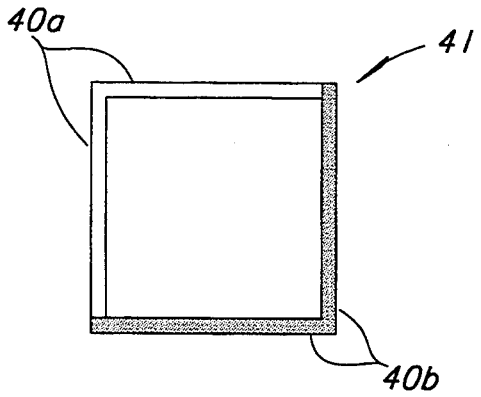
FIGS. 5*a*, 5*b*, 5*c* and 5*d* each show inner or outer borders for combined borders generated in accordance with the preferred embodiment of the present invention.

FIG. 5*a* shows a raised inner border 41 (+2 equivalence class). The top and left border edges 40*a* are glare border edges and are assigned a white color with a luminance of 240 in the HSV scale. In contrast, the right and bottom border edges 40*b* are shadow border edges, and the border edges 40*b* are assigned a dark gray color with a luminance of 60 in the HSV scale. The luminances are assigned to the border edges in this fashion to give the illusion of height. The human eye perceives transitions from lighter to darker as the eye moves from left to right as a raised surface.

Figure 5B:
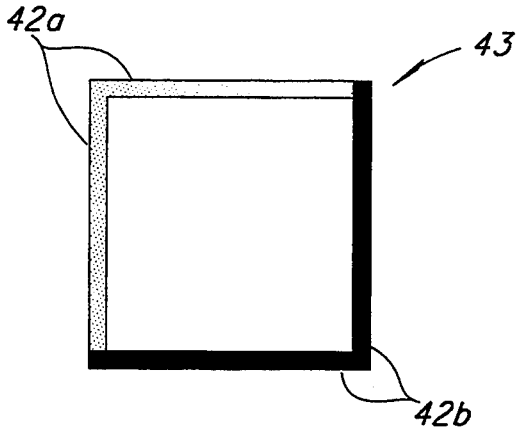

FIG. 5*b* shows a raised outer border 43 (+1 equivalence class). Like the raised inner border 41, in the raised outer border 43 the top and left border edges 42*a* are glare border edges and the right and bottom border edges 42*b* are shadow border edges. The top and left border edges 42*a* are given a light gray color with a luminance of 180 in the HSV scale, while the right and bottom border edges 42*b* are given a black color with a luminance of 0 in the HSV scale.

Figure 5C:
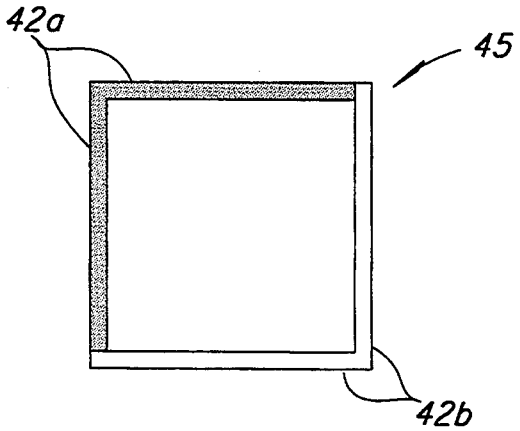

As mentioned above, when the borders are sunken, the border edges that are glare border edges and the border edges that are shadow border edges are reversed relative to the border edges of the raised borders. FIG. 5*c* shows an example of a sunken outer border 45 (+1 equivalence class). In the sunken outer border 45, the top and left border edges 42*a* are shadow border edges and assigned a dark gray color with a luminance of 60 in the HSV scale. The right and bottom border edges 42*b* are assigned a white color with a luminance of 240 in the HSV scale. The transition as one moves from left to right from a darker color to a lighter color is perceived as sunken.

Figure 5D:
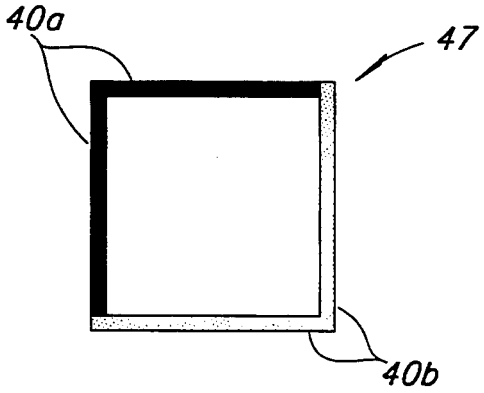

The shading of the inner border, likewise, changes when the inner border is sunken. FIG. 5*d* shows an example of a sunken inner border 47 (−2 equivalence class). The top and left border edges 40*a* are shadow border edges and assigned a black color with a luminance of 0 in the HSV scale. The right and bottom border edges are glare border edges and assigned a color of light gray with a luminance of 180 in the HSV scale.

Figure 6A:
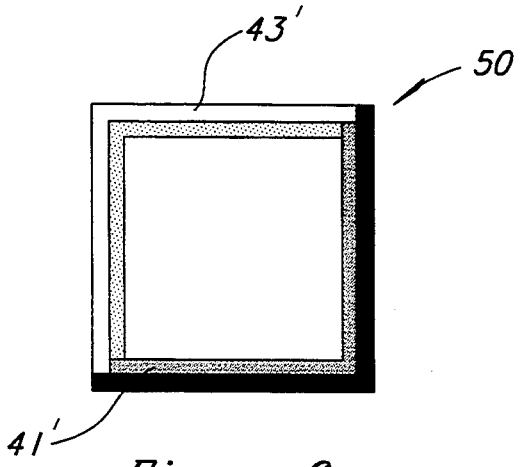
FIGS. 6*a*, 6*b*, 6*c*, 6*d* and 6*e* each show combined borders that are generated in accordance with the preferred embodiment of the present invention.

Unfortunately, the inner borders 41 and 47 and the outer borders 43 and 45 do not alone provide a robust enough perception of height or depth. As such, the preferred embodiment of the present invention combines the inner and outer borders into pairs to improve the perception of depth. FIGS. 6*a*–6*e* illustrate the combined borders, consisting of combinations of inner and outer borders, that are provided by the preferred embodiment of the present invention. FIG. 6*a* shows an example of a combined border 50 having a raised outer border 43' and a raised inner border 41'. This combined border 50 is used to achieve the appearance of height and is useful in providing borders for push buttons, graphic buttons, text buttons and scroll bar buttons. Since, however, push buttons and the like are likely to appear on the video display 22 adjacent to a gray background, the colors assigned to the top and left border edges for the outer border 43 and the inner border 41' are swapped from the raised outer border 43 (FIG. 5*b*) and the raised lower border 41 (FIG. 5*a*), that are described above. The colors are swapped because, otherwise, it is difficult to see the top and left border edges of the outer border against the gray background.

Figure 6B:
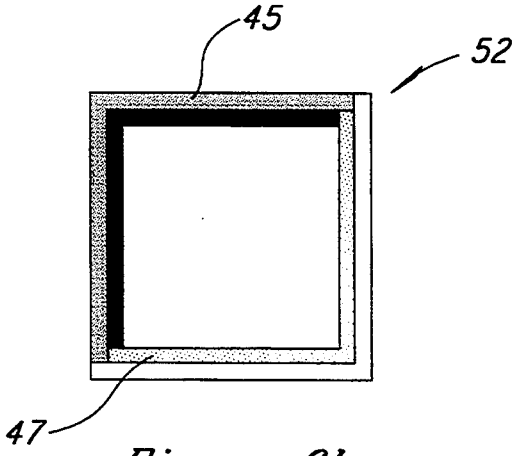

FIG. 6*b* shows an example of a combined border 52 that combines a sunken outer border 45 with a sunken inner border 47. This combined border 52 is useful to specify entry fields because the combined border provides the user with a visual cue that the entry field must be filled in.

Figure 6C:
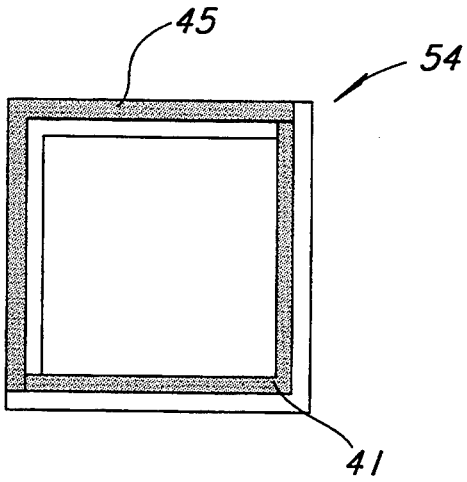

FIG. 6*c* shows an example of a combined border 54 that combines a sunken outer border 45 with a raised inner border 41. Combined border 54 is useful as a group border that provides the user with a visual cue that objects surrounded by the group border are related. Combined border 54 provides a visual perception of depth but at a lesser degree than combined border 52 (FIG. 6*b*).

Figure 6D:
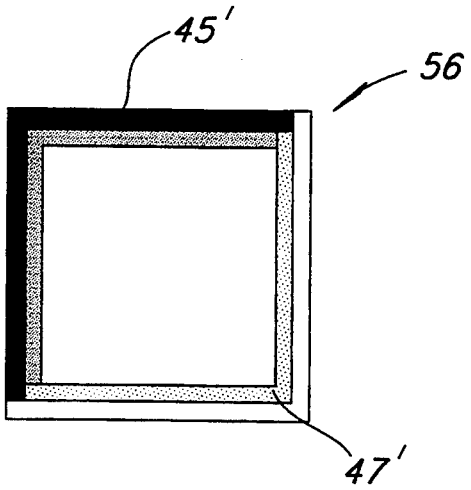

FIG. 6*d* shows an example of a combined border 56 that is used for push buttons. The combined border 56 includes a sunken outer border 45' and a sunken inner border 45'. The combined border 56 differs from the combined border 52 (FIG. 6*b*) in that the colors assigned to the top and left border edges of the outer border and inner border are swapped. The colors for the top and left border edges are swapped because push buttons are typically adjacent to a gray background. By making the top and left border edges of the outer border 45' black, the necessary contrast exists to differentiate the push buttons from the background.

Figure 6E:
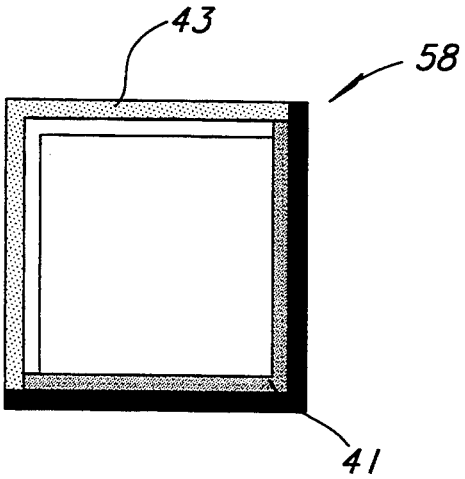

A final combined border 58 that is provided in the preferred embodiment of the present invention is shown in FIG. 6*e*. Combined border 58 combines a raised outer border 43 with a raised inner border 41. The colors of the top and left border edges of the outer border 43 and the inner border 41 are not reversed in this case, because the combined border 58 is used with window tiles that are most likely to be adjacent to a white background rather than a gray background. Accordingly, there is no need to swap the colors, as was done in combined border 50 of FIG. 6*a*.

The border styles provided by the preferred embodiment of the present invention differentiate controls on the system user interface such that the user has some visual indicator of the type of control. Moreover, the border styles indicate to the user what action may be performed on the control. As such, the preferred embodiment of the present invention enhances the ease with which controls may be utilized.

While the present invention has been described with reference to a preferred embodiment thereof, those skilled in the art will, nevertheless, appreciate that various changes in form and detail may be made without departing from the present invention as defined in the appended claims.

I claim:

1. In a data processing system having a processor and a video display, a method of drawing a border on an output device, wherein the border includes an inner border having border edges and an outer border having border edges, the method comprises the steps of:

(a) providing a range of logical depths relative to a zero level logical depth on the output device that the inner border and the outer border may assume, wherein the range includes at least one sunken logical depth and at least one raised logical depth;

(b) predetermining colors for the border edges of the inner border or the outer border for each logical depth to produce a visual effect of the logical depth when the borders are output on the output device; and (c) outputting the border on the output device by drawing the outer border to have a first logical depth in the range of logical depths and drawing the inner border to have a second logical depth in the range of logical depths, wherein the outer border has border edges with the colors that are assigned to the border edges for the first logical depth and the inner border has border edges with the colors that are assigned to the border edges for the second logical depth.

2. The method as recited in claim 1 wherein the step of providing a range of logical depths further comprises the step of providing at least two raised logical depths and at least two sunken logical depths relative to the zero level logical depth on the output device.

3. The method as recited in claim 1 wherein the step of assigning colors to the border edges further comprises the steps of:

determining where a logical light source is located on the zero level logical depth relative to the border;

for each logical depth, given the logical light source location, determining which of the border edges of the inner border or the outer border are in shadow and which of the border edges are in glare; and assigning a first color to the border edges that are in glare a first color, and assigning a second color to the border edges that are in shadow.

4. The method as recited in claim 3 wherein the step of determining where the logical light source is located further comprises the step of determining that the logical light source is in the top left corner of the zero level logical depth and the inner border and the outer order each include top, left, right, and bottom border edges.

5. The method as recited in claim 4 wherein, for each of the raised logical depths, the step of determining which of the border edges are in shadow and which of the border edges are in glare further comprises the step of determining that the top and the left border edges are in glare and the bottom and the right border edges are in shadow.

6. The method as recited in claim 4 wherein, for each of the sunken logical depths, the step of determining which of the border edges are in shadow further comprises the step of determining that the top and the left border edges are in shadow and the bottom and the right border edges are in glare.

7. The method as recited in claim 1wherein the first logical depth is one of the sunken logical depths and the second logical depth is one of the sunken logical depths.

8. The method as recited in claim 1 wherein the first logical depth is one of the sunken logical depths and the second logical depth is one of the raised logical depths.

9. The method as recited in claim 1 wherein the first logical depth is one of the raised logical depths and the second logical depth is one of the raised logical depths.

10. In a data processing system having a processor, memory means and an output device, a method comprising the steps of:

(a) determining a required number of shades to differentiate among different heights that borders may assume when output by the output device;

(b) using the processor to determine a range of luminances available on the output device;

(c) using the processor to determine luminance values of shades that are spread across the range of luminances to provide the required number of shades; and (d) drawing a border with the output device that has portions at different heights, wherein the portions at different heights are assigned different ones of the determined luminance values to differentiate the heights.

* * * * *